US006293036B1

(12) United States Patent
Westermann

(10) Patent No.: US 6,293,036 B1
(45) Date of Patent: Sep. 25, 2001

(54) INFORMATION CASSETTE

(76) Inventor: Gerhard Westermann, Am Weissen Stein 1, 76571 Gaggenau (DE)

( * ) Notice: Subject to any disclaimer, the term of this patent is extended or adjusted under 35 U.S.C. 154(b) by 0 days.

(21) Appl. No.: 09/299,190

(22) Filed: Apr. 23, 1999

Related U.S. Application Data

(63) Continuation-in-part of application No. PCT/DE97/02483, filed on Oct. 23, 1997.

(30) Foreign Application Priority Data

Oct. 24, 1996 (DE) ..... 196 43 414

(51) Int. Cl.[7] ..... G09F 7/02
(52) U.S. Cl. ..... 40/618; 40/576
(58) Field of Search ..... 40/576, 618

(56) References Cited

U.S. PATENT DOCUMENTS 1,524,668 * 2/1925 Miller et al. ..... 40/618
1,994,686 * 3/1935 Chernow ..... 40/618
2,745,201 * 5/1956 Giuseppe et al. ..... 40/618
3,387,397 * 6/1968 Buchanan et al. ..... 40/618
3,742,633 * 7/1973 Palm ..... 40/576
5,257,472 * 11/1993 Harnois et al. ..... 40/606
5,267,405 * 12/1993 Seggerson ..... 40/618
5,357,701 * 10/1994 Grate ..... 40/618

FOREIGN PATENT DOCUMENTS 19643414.9 * 2/1998 (DE) .
WO 98/18113 * 4/1998 (WO) .

OTHER PUBLICATIONS

Printout from Derwent for WO 98/18113.*

* cited by examiner

*Primary Examiner*—B. Dayoan
*Assistant Examiner*—Andrea Chop
(74) *Attorney, Agent, or Firm*—Klaus J. Bach

(57) ABSTRACT

In an information cassette for receiving exchangeable information carriers including a carrier housing, the carrier housing has bent over top and bottom end walls and a T-shaped center web so as to form two information carrier sections covered by hinge lids on which the information carriers can be mounted and which have bottom walls with springs on which the hinge lids are seated in the carrier housing and which resiliently bias the hinge lids upwardly such that the top ends of the hinge lids are engaged behind the front edges of the bent-over carrier housing top end wall or the T-shaped center web, respectively.

6 Claims, 3 Drawing Sheets

INFORMATION CASSETTE

This is a continuation-in-part application of international application PCT/DE97/02483 filed Oct. 23, 1997 and published Apr. 30, 1998 and claiming the priority of German application 196 43 414.9 filed Oct. 24, 1996.

FIELD OF INVENTION

The present invention relates to an information cassette.

More particularly, the invention relates to an information cassette for exchangeable information carriers with a carrier housing, including at least one partially transparent hinged lid, which can be opened by a swivel movement and has at least one integrated drawer for receiving an information carrier.

BACKGROUND OF THE INVENTION

Such information cassettes are known for example from the published EP 0 383 042. Those information cassettes consist substantially of a basic body, a hinged lid, and a closeable cassette. The hinged lid, which is pivotable above the basic body, is link-supported by the basic body. The pivot axis of the closing lid is in the lower region of the basic body. Several drawers for receiving part information carriers are arranged in the basic body. Above these drawers a drawer for a further part information carrier is arranged in the hinged lid. The drawer, including the information carrier received therein is situated above, and in front of, the part information carriers of the drawers of the basic body. After insertion or exchange of the part information carriers, the closeable information cassette is mounted over the upper part of the combination of the basic body and the hinged lid of the closed information cassette. The closeable cassette locks the information cassette.

Such a cassette has several disadvantages. On one hand, the handling of the information cassette is cumbersome and expensive. Thus, for exchanging partial information carriers always at least two parts must be moved. The closeable cassette has to be taken off and the hinged lid is to be pivoted open. When being pivoted open, the hinged lid can move to a fully open position, so that an information carrier can fall out. On the other hand, not all information carriers are in a single plane behind the display panel, which can, amongst others, influence the legibility by unfavorable shadow formation or sliding of the front information carrier.

Furthermore, due to the large exposed surface of the closeable cassette, there always is the danger that it can be pushed upwardly by persons or articles such that the information cassette is opened.

Furthermore, from the DE 72 22 056 U1, an information table is known, which includes signs, that are movable sideways onto separate cassettes. The signs are located in guide rails at the outer walls of the individual cassettes. They are prevented from sliding out of place by using side rails. The cassettes themselves are removed for exchanging the signs in a push and pivot movement and are re-inserted similarly. This information table however is of a complicated design and requires several operating steps for exchanging the signs.

The invention therefore has as its principal object to create an information cassette allowing a rapid and reliable exchange of the information carriers in a simple and uncomplicated procedure. At the same time, the information cassette must be robust. Furthermore, the design must prevent an unintended opening by external influences. Of course, the disadvantages of the prior art arrangements should be avoided.

SUMMARY OF THE INVENTION

In an information cassette for receiving exchangeable information carriers including a carrier housing, the carrier housing has bent over top and bottom end walls and a T-shaped center web so as to form two information carrier sections covered by hinge lids on which the information carriers can be mounted and which have bottom walls with spring means on which the hinge lids are seated in the carrier housing and which resiliently bias the hinge lids upwardly such that the top ends of the hinge lids are engaged behind the front edges of the bent-over carrier housing top end wall or the T-shaped center web, respectively.

The spring means may consist of at least two spring arms arranged at an end wall of the lid parallel to the swivel axis of the hinged lid.

The spring arms are bending springs which may project from the side wall forming the bottom of the hinged lid at an angle of about 15–30° relative to the pivot axis of the hinged lid in such a way that their respective free ends are directed outwardly.

The design provides for a robust information cassette, which is simple to handle. When the information cassette is closed, the hinge lid is seated fully in the protective carrier housing. The spring mechanism and the guide parts, in which the hinge lid is fitted, are then all disposed in the protective carrier housing. In this manner, the information cassette can take the usual mechanical bumps in all directions without being damaged. Also, if dropped, the information cassette does not open on impact on the floor.

DESCRIPTION OF A PREFERRED EMBODIMENT

Figure 1A:
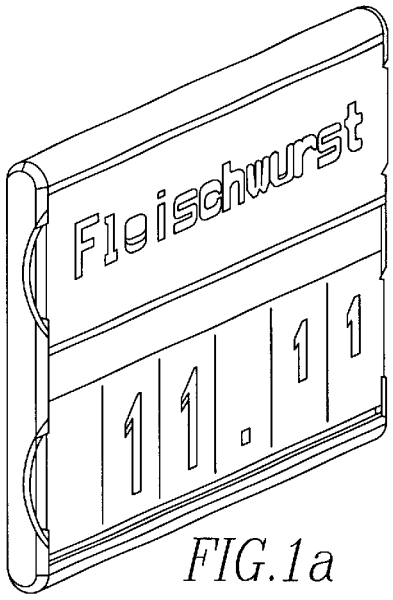
FIGS. 1*a* and 1*b* show an information cassette when closed (FIG. 1*a*) and when opened (FIG. 1*b*).
Figure 1B:
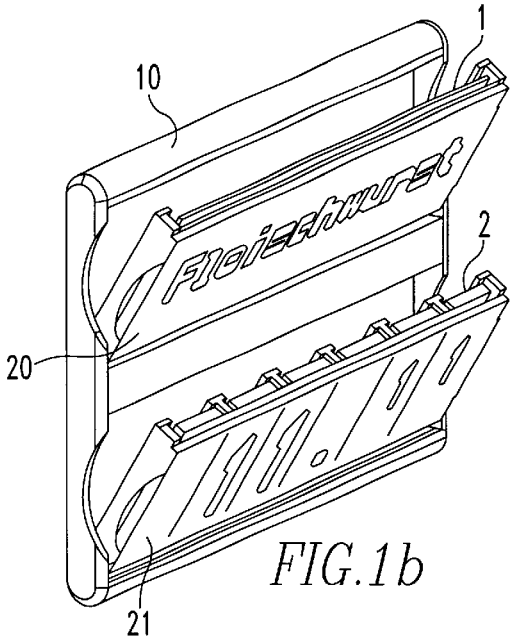

FIGS. 1*a* and 1*b* show an information cassette, in which two superimposed hinge lids 20, 21 with integrated drawers are fitted in a carrier housing 10. In FIG. 1*b*, the hinge lids 20, 21 are shown opened. At the opening angle as shown, the hinge lids 20, 21 can be removed by pulling them out in opening direction from the carrier housing 10. The upper lid 20, for example, can contain a single drawer, into which a card 1 with a recorded description of goods is placed as information carrier. The lower hinge lid 21 contains six similarly sized drawers, which receive individual zig-zag folds 2 as information carriers. The zig-zig folds 2 each can display, for example total or individual price information or brief information relating to a product and/or packaging.

Figure 2:
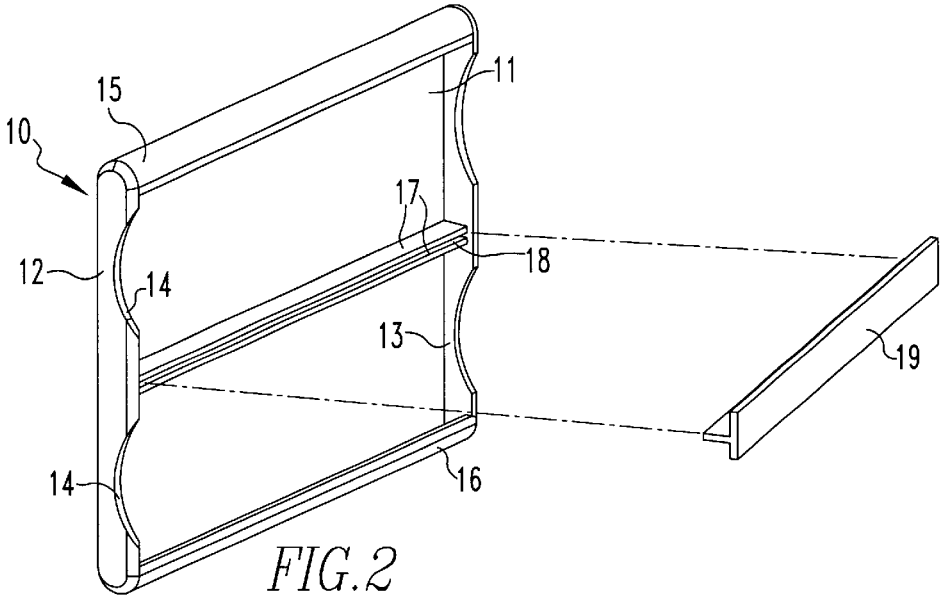
FIG. 2 is a perspective view of a carrier housing of the information cassette of FIGS. 1*a* and 1*b* partially exploded.
Figure 3:
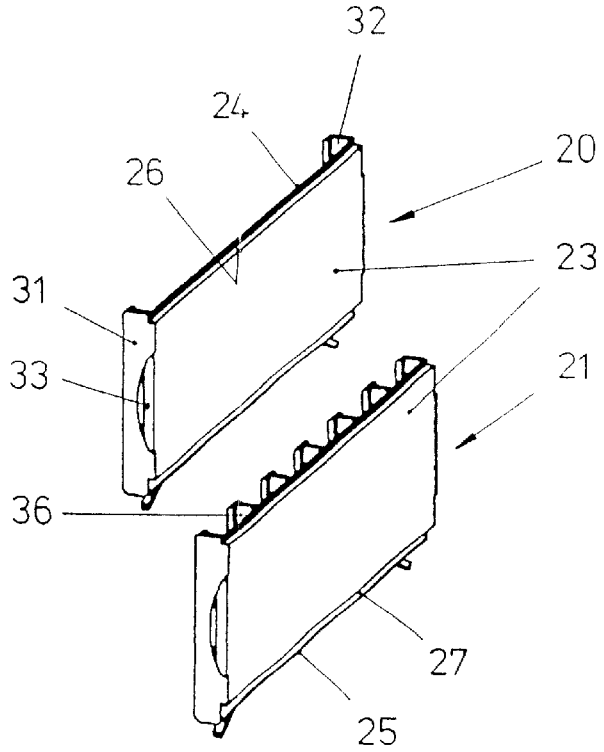
FIG. 3 is a perspective front view of the hinge lid components of the information cassette.
Figure 4:
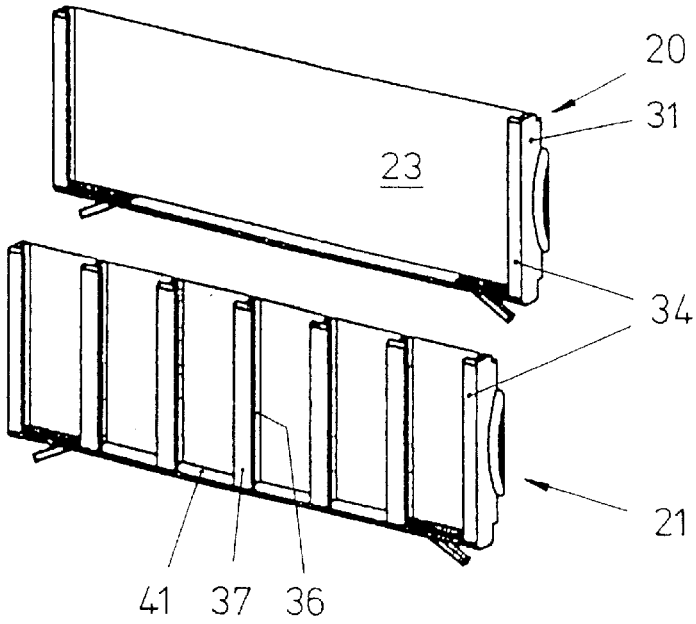
FIG. 4 is a perspective rear view of the hinge lid components of FIG. 3.
Figure 5A:
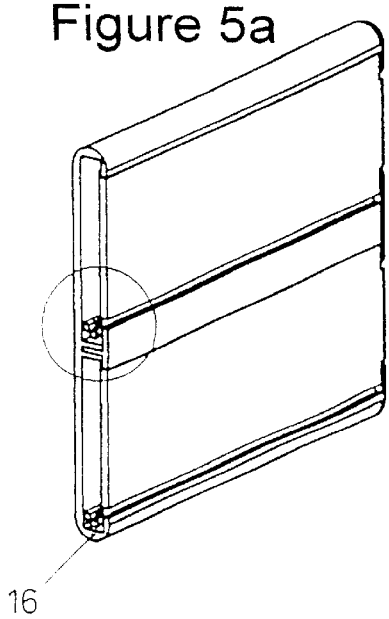
FIG. 5*a* is a cross-sectional view taken transversely through the information cassette of FIG. 1*a,*

In FIG. 2, the carrier housing 10 is shown with a front ledge 19 on the right, which still is to be fitted into the housing 10. The carrier housing 10 has a flat rear wall 11 joined at both ends by side walls 12, 13 which extend substantially at right angles. At the top and the bottom, the rear wall 11 is bent over to form a wrap-around shaped top and bottom end walls 15, 16. These end walls 15, 16 have a semicylindrical outer contour. They extend, for example, seamlessly without transition from the rear wall 11. Together with the end walls 15, 16, the carrier housing 10 has a substantially C-shaped cross-section, as can be clearly seen in the section shown in FIG. 5*a*.

Figure 5B:
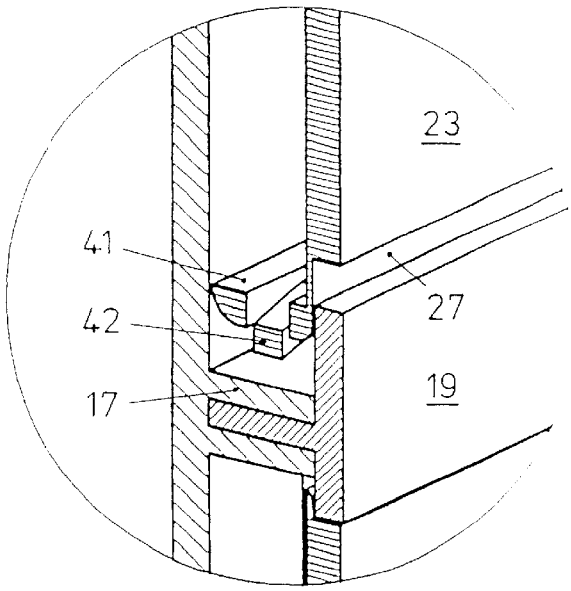
FIG. 5*b* shows the region of a part of a spring mechanism as encircled in FIG. 5*a,*
Figure 6A:
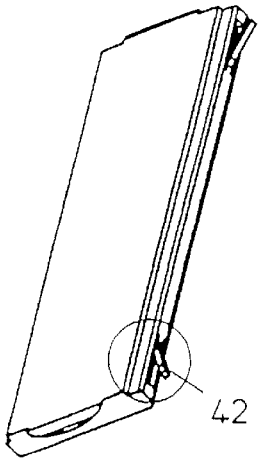
FIG. 6*a* is a perspective view from below of a hinged lid of FIG. 3.
Figure 6B:
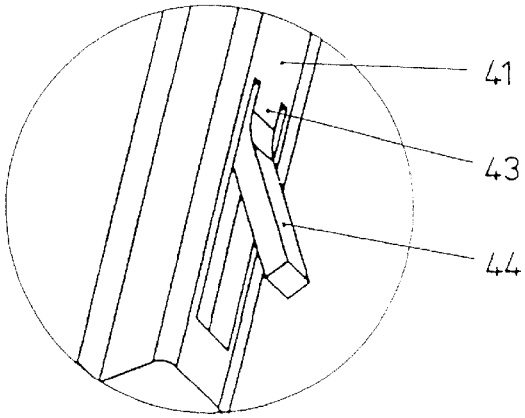
FIG. 6*b* is an enlarged view of the area encircled in FIG. 6*a.*

Two continuous parallel spaced webs 17 are arranged one above the other approximately in the center of the front side of the rear wall 11. The web of the front ledge 19 which has a T-shaped cross-section forms a leg, which is insertable into the gap 18 between the webs 17 and, if necessary, is glued to the webs. The webs 17, 18 in combination with the front ledge 19 divide the carrier housing 10 into an upper and a lower region. Each region itself forms a separate receptacle for a hinged lid 20, 21, wherein at least the lower zones are channel or gutter shaped. In the sectional enlargement of FIG. 5*b*, the upper channel shaped region can be seen.

Obviously, the front ledge 19 can also be formed integrally with the carrier housing 10.

Each side wall 12, 13 of the carrier housing 10 has for each hinge lid 20, 21 a curved segment recess 14 formed in its front edge. The recess 14 is located about in the center of each hinged lid region. The depth of the recess 14 corresponds approximately to half the depth or half the thickness of the information cassette.

In the FIGS. 3, 4, 6*a* and 6*b* various views of the hinge lids are shown. The front side of each individually hinge lid 20, 21 forms the so-called display panel 23. Here, it is fully transparent. If necessary it can be made opaque by coloring it, applying a layer to it, printing on it or the like. The display panel 23 is provided with side walls 31, 32 with the exception of the upper front edge. Each vertically arranged side wall 31, 32 is provided with a gripping portion 33. When the information cassette is closed, the individual gripping portion 33 fits into its associated recess 14 in the carrier housing 10. A gap of about 1 mm is present between the carrier housing 10 and the gripping portion 33; see FIG. 1*a*.

Transverse webs 34 are arranged at the side walls 31, 32 parallel to the inspection panel 23, which engage the individual information carriers 1, 2. In the hinge lid 20, the two transverse webs 34 fix the card 1 of FIG. 1*b* normally to the display panel 23. When the card 1 is inserted into the hinge lid 20, the card 1 is retained in place and is prevented by the transverse webs 34 from being caught between one of the side walls 31, 32 and the carrier housing 10, when the lid is closed so that the lid can always be properly closed.

The hinge lid 21 has five parallel transverse separation webs 36 extending between the side walls 31, 32 so that six drawers for receiving information carriers 2 are created. Each separation web 36 respectively, has a transverse web 37, which projects at both sides for about 1 mm beyond the separation web 36, thereby forming a retaining part. The zig-zag folds 2 are supported against the display panel 23 at the wrap around or bent-over parts.

Each hinge lid 20, 21 has a bottom 41, which joins the respective side walls 31, 32 of the display panel 23. In the respective individual bottom 41 two elastically bendable leaf spring-like elements 42 are integrated: see FIGS. 5*b* and 6*b*. These flexible springs 42, which are arranged near the side walls 31, 32 project at an angle of about 25° from the bottom down and outwardly when unloaded. Each bending spring 42 has a length and is shaped in the form of an angle so that it consists of two legs 43 and 44. The leg 43, which is shorter than the other, extends substantially parallel to the bottom 41. In the unloaded condition, the two legs 43, 44 form an angle of 155°. In the bent position the legs 43, 44 form an arc. The bending spring 42 has a substantially uniform rectangular cross-section over its length. It is also possible to change the spring rate of the bending springs 42 by having a varying cross-section at least over a part of their length. For example, the cross-section could narrow towards their free ends.

The bending spring 42 has, compared to the surrounding bottom 41, a play of several tenths of millimeters. Thus, it can be turned slightly without touching the floor bottom 41 or without tilting over when being tensioned.

When the information cassette is closed, the bending springs 42 of the upper hinge lid 20 are supported at the upper web 17, whereas the bending springs 42 of the lower hinge lid are supported at the inner side wall 16 which is the flat inner bottom wall of the carrier housing.

Each hinged lid 20, 21 is designed to have steps 26, 27 at the upper and lower edges, that is, in the region of the edges 24, 25 of the display panel 23. In the region of the steps 26, 27, the wall thickness of the hinged lid 20, 21 is less than in the display panel region. The steps 26, 27 have a depth, which corresponds to about the material thickness of the regions of the horizontal end walls 15, 16 of the carrier housing 10 surrounding the hinge lids 20, 21 or the wall thickness of the transverse web of the front ledge 19. Due to this design, when the information cassette is closed, the inspection panel 23 of the hinge lid 20, 21 and the front region of the carrier housing 10 are disposed substantially in a single plane.

The height of the lower step 27 is greater than the height of the upper step 26 and larger than the closure stroke of the individual hinge lid 20, 21. The overall height of a hinge lid 20, 21 is larger than the distance between the lower edge of the upper end wall 15 and the upper edge of the front ledge 19 or the distance between the lower edge of the front ledge 19 and the upper edge of the lower end wall 16.

Because each hinge lid 20, 21 is covered on all the sides with the exception for the gripping part 33, the hinge lid 20, 21 can be opened and closed by way of a combined push and tilt movement.

An empty information cassette is opened for loading part information carriers 1, 2. Thus for example the hinge lid 20 is pushed at its two grip parts 33 downwardly to be opened. For the upper hinge lid 20, the displacement movement is completed when the lower step 27 is completely covered by the front ledge 19. In this case, the inspection panel 23 abuts substantially tightly against the front ledge 19. Furthermore, in this position, the two bending springs 42 are tensioned to their maximum extent. Simultaneously, the front edge 24 of the hinge lid 20 is located below the wrapping around or bent over bottom edge of the upper end wall 15. From this position, the hinge lid 20 is pivoted to the front until it is below the upper end wall 15. Then it can be removed at an angle to the front and upwardly.

If, when opening the hinge lid 20, it is displaced only on one side—for example, at only one grip portion 33—then the part of the front edge 24, which is not displaced, remains behind the wrap around or bent over part of the upper end wall 15. The hinge lid 20 can then not be opened. This offers a protection against unintended opening of the information cassette.

After insertion of an information carrier into a drawer, the hinge lid 20 is inserted, together with the bending spring 42 into the carrier housing 10. For this purpose, the hinge lid 20 is held at an opening angle relative to the carrier housing 10, as can be seen from the representation of the open information cassette in FIG. 1*b*. When both bending springs 42 rest on the upper web 17 (see FIG. 5), the hinge lid 20 is pressed downwardly until its front edge 24 passes through the bottom edge of the upper side wall 15. After the hinge lid 20 is pivoted into the carrier housing 10 it is pressed by the bending springs 42 upwardly until the front ledge 26 disappears completely behind the bottom edge of the upper end wall 15 wrapping around or bending over the hinge lid 20.

Since the side walls 31, 32 and the separation webs 36 are bevelled to the rear—that is, away from the display panel or front edge 25—the hinge lid 20, 21, after insertion of its bottom into the carrier housing 10, can be closed by simply pressing it to a closed position. The inclined upper edges of the side walls 31, 32 or the separation walls 36 cause any necessary lateral movement during the closing swivel movement.

The information cassettes have, for example, at the rear side 11 of the carrier housing 10, an attachment structure for mounting them onto a support base. The support base, which may be for example an information rail at the front edge of a shelf carries for this purpose, dove-tailed parts, which can be engaged by two rails arranged on the back of the information cassette.

What is claimed is:

1. An information cassette for receiving exchangeable information carriers comprising: a carrier housing, an at least partially transparent hinge lid including a display panel and having a bottom supported in said carrier housing, said hinge lid having drawer sections formed therein for receiving said information carriers, said carrier housing having bent-over top and bottom end walls and a T-shaped center strip extending between, and parallel to, said bent-over top and bottom end walls, said hinge lid having a top and a bottom end with spring means disposed at the bottom end and fitting behind a web portion of said T-shaped center strip or, respectively, said bent-over bottom end wall for retaining said hinge lid on said carrier housing, said hinge lid being movable downwardly against the force of said spring means so as to release its top from said bent-over top end wall or, respectively, the web portion of the T-shaped center strip to permit outward tilting of the hinge lid and removal thereof from said carrier housing, said drawer sections only being capable of receiving said information carriers when said hinge lid is outwardly tilted away from said carrier housing.

2. An information cassette according to claim 1, wherein said hinge lid has a bottom wall and said spring means consists of at least two flexible spring straps, which are arranged at the bottom wall of each hinge lid and extend essentially parallel to the bottom wall of the hinge lid.

3. An information cassette according to claim 2, wherein said spring straps project from the bottom wall of said hinge lid at an angle of 15–30° relative to the bottom wall of said hinge lid such that said spring straps have outwardly directed free ends.

4. An information cassette according to claim 2, wherein said spring straps are formed integrally with the hinge lid and comprise each two leg portions which extend at an angle with respect to each other and are disposed in the plane of the bottom wall of the hinge lid.

5. An information cassette according to claim 1, wherein said hinge lid has a front wall and side walls extending normal to the front wall of the hinge lid.

6. An information cassette according to claim 5, wherein the side walls of said hinge lid have transverse webs which form the side limits of a drawer for receiving an information carrier.

* * * * *